US008414680B2

(12) United States Patent
Karlsson

(10) Patent No.: US 8,414,680 B2
(45) Date of Patent: Apr. 9, 2013

(54) METHOD AND DEVICE FOR CONTROLLING AN ELECTROSTATIC PRECIPITATOR

(75) Inventor: Anders N. G. Karlsson, Braas (SE)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 12/808,717

(22) PCT Filed: Dec. 16, 2008

(86) PCT No.: PCT/EP2008/010676

§ 371 (c)(1),
(2), (4) Date: Jun. 17, 2010

(87) PCT Pub. No.: WO2009/086887

PCT Pub. Date: Jul. 16, 2009

(65) Prior Publication Data

US 2010/0313747 A1 Dec. 16, 2010

(30) Foreign Application Priority Data

Jan. 9, 2008 (EP) ..... 08150118

(51) Int. Cl.
*B03C 3/68* (2006.01)

(52) U.S. Cl. ..... 95/4; 95/26; 95/81; 96/19; 96/25

(58) Field of Classification Search ..... 95/4, 26, 95/5, 81; 96/19, 25, 20, 80; 110/216, 345
See application file for complete search history.

(56) References Cited

U.S. PATENT DOCUMENTS 3,431,707 A * 3/1969 Berg ..... 95/4
3,989,486 A 11/1976 Baysinger
4,333,746 A * 6/1982 Southam ..... 96/19
4,400,184 A * 8/1983 Tomita et al. ..... 96/19

(Continued)

FOREIGN PATENT DOCUMENTS

EP 457224 A1 * 11/1991 ..... 96/19
EP 1 277 928 1/2003

(Continued)

OTHER PUBLICATIONS

N.V.P.R. Durga Prasad, T. Lakshminarayana, J.R.K. Narasimham, Thenmozhi M. Verman, C.S.R. Kriskhnam Raju. "IEEE Transactions on Industry Applications", *Automatic Control and Management of Electrostatic Precipitator*, vol. 35, No. 3, pp. 561-567, May/Jun. 1999 (Jan. 5, 1999).

(Continued)

*Primary Examiner* — Richard L Chiesa
(74) *Attorney, Agent, or Firm* — Rita D. Vacca

(57) ABSTRACT

A method or device for controlling the operation of an electrostatic precipitator, ESP, is provided. The ESP is used to remove dust particles from a process gas generated by a combustion process. An indicator signal is generated, typically by a temperature sensor, which signal is indicative of the temperature of combustion air fed to the combustion process. The ESP is operated in a manner depending on the indicator signal. Thereby, back-corona effects may be avoided to a great extent.

14 Claims, 3 Drawing Sheets

U.S. PATENT DOCUMENTS

| | | | | |
|---|---|---|---|---|
| 4,614,526 | A | 9/1986 | Gilles et al. | |
| 4,816,979 | A | 3/1989 | Domann et al. | |
| 5,114,442 | A | 5/1992 | Artz | |
| 5,163,983 | A | 11/1992 | Lee | |
| 5,378,978 | A | 1/1995 | Gallo et al. | |
| 5,922,103 | A * | 7/1999 | Schwab et al. | 95/8 |
| 7,081,152 | B2 * | 7/2006 | Altman et al. | 95/5 |
| 2006/0249024 | A1 * | 11/2006 | Shimoda et al. | 96/19 |

FOREIGN PATENT DOCUMENTS

| | | |
|---|---|---|
| EP | 1 640 574 | 3/2006 |
| JP | 94160/85 | 5/1985 |
| JP | 212312/93 | 8/1993 |

OTHER PUBLICATIONS

PCT International Search Report and Written Opinion of the International Searching Authority dated Jun. 26, 2009 (PCT/EP2008/010676).

European Search Report dated Mar. 7, 2008.

* cited by examiner

METHOD AND DEVICE FOR CONTROLLING AN ELECTROSTATIC PRECIPITATOR

This is a US National Phase application claiming priority to International Application No. PCT/EP2008/010676 having an International Filing Date of Dec. 16, 2008, incorporated herein in its entirety by reference.

TECHNICAL FIELD

The present disclosure relates to a method of controlling the operation of an electrostatic precipitator, which is operative for removing dust particles from a process gas, which is generated by a combustion process. The disclosure further relates to a device for controlling the operation of an electrostatic precipitator.

BACKGROUND

Electrostatic precipitators (ESPs) have been widely used for many decades to remove dust particles from process gases such as exhaust gases from combustion processes. One example of an ESP is disclosed in U.S. Pat. No. 5,114,442.

One problem associated with ESPs is so-called back-corona effects, i.e. that the resistivity of a layer of already collected dust particles on an electrode causes a drop in a generated electric field which may reintroduce collected particles into the process gas.

SUMMARY

An object of the present disclosure is therefore to provide a method or a device for controlling an ESP that has an improved capability of avoiding back-corona effects while maintaining efficient removal of dust particles from a process gas.

This object is achieved by means of a method of controlling the operation of an electrostatic precipitator, ESP, which is operative for removing dust particles from a process gas, which is generated by a combustion process, characterized by generating an indicator signal which is indicative of the temperature of combustion air fed to the combustion process, and operating the ESP in a manner depending on the indicator signal. The inventor has found that back-corona effects are correlated to the temperature of the combustion air that is supplied to the combustion process. The higher the temperature, the higher the risk of back-corona effects occurring. Therefore, by adapting the ESP control to the combustion air temperature, the ESP can be made more efficient.

One option for adapting the ESP is to control the average current fed to the electrodes of the ESP based on the indicator signal, such that the average current decreases with increasing combustion air temperature. This effectively adapts the ESP to the more back-corona prone dust that a higher combustion air temperature produces.

Another way of achieving such adaptation, in a case when the electrodes of the ESP are fed with voltage/current pulses, is to increase the length of the intermittent time between pulses with increasing combustion air temperature. This may be achieved, for instance, by utilizing fewer potential pulses in a semi-pulse supply arrangement.

Yet another way is to initiate rapping of ESP electrodes at instants when the combustion air temperature is comparatively low, such that rapping disturbances are confined to periods of time when the ESP is subjected to back-corona effects to a lesser extent.

The indicator signal may typically be generated by means of a temperature sensor. However, a timer may also be used to produce an indicator signal, for instance in tropic or subtropic regions where the temperature varies in a reasonably predictable way during the day.

The object is further achievable by means of a device for controlling the operation of an electrostatic precipitator, ESP, which is operative for removing dust particles from a process gas, which is generated by a combustion process, characterized by said device being operative for receiving an indicator signal which is indicative of the temperature of combustion air fed to the combustion process, and in that the device is adapted to operate the electrostatic precipitator in a manner depending on the indicator signal.

DETAILED DESCRIPTION

Figure 1:
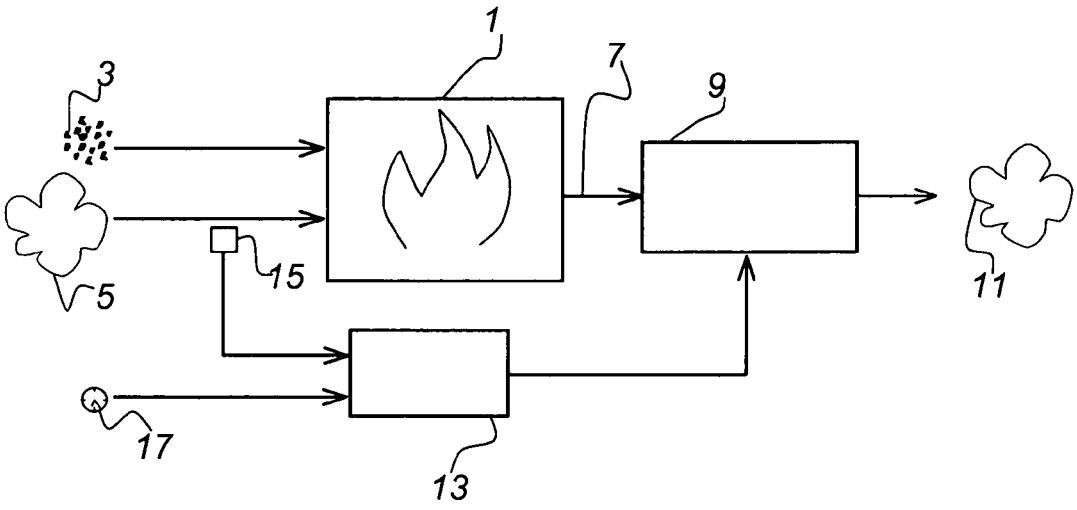
FIG. 1 illustrates schematically a combustion process arrangement where an electrostatic precipitator, ESP, is used to remove dust particles from generated process gases.

FIG. 1 illustrates schematically a combustion process arrangement where an electrostatic precipitator is operative for removing dust particles from process gases generated in a combustion process.

The combustion process may be carried out in a boiler 1 to which combustible material such as coal 3 and combustion air 5 is supplied. The combustion process generates process gases 7 which contain dust particles. The process gases, i.e. exhaust gases sometimes referred to as flue gases, are supplied to an electrostatic precipitator, ESP, 9 which removes particles from the gas stream to generate an output gas flow 11, which contains comparatively few particles and which may be treated in additional process steps (not shown) to remove non-particle pollutants such as sulfur dioxide.

The present disclosure relates to a control arrangement 13 which controls the operation of the ESP 9 based on the temperature of the combustion air. This allows the ESP operation to be improved in several ways, as will be described later, while maintaining a low amount of dust particle residue in the output gas flow 11.

In general it has been found that the higher the combustion air 5 temperature is, the higher is the risk of back-corona effects. This becomes particularly salient in tropic and subtropic climate zones where the daytime combustion air temperature may often exceed 40° C.

The control arrangement 13 of the present disclosure obtains an indicator signal which is indicative of the temperature of combustion air fed to the combustion process. Typically, this indicator is an actual sensor signal from a temperature sensor 15 which senses the temperature of the combustion air flow. Such a sensor may typically be placed at the combustion air inlet, or in the actual flow. However, it is possible also to use a temperature sensor that is placed in ambient air anywhere in the vicinity of the plant in question. In such a case, it may be useful to choose a location that is exposed to direct sunlight at roughly the same points of time as the combustion air inlet.

It should be noted that an indicator signal in principle may be obtained also without the use of a temperature sensor. Temperature variations may in many locations be highly correlated both with time of day and time of year and therefore an indicator signal based on a clock 17 would also be conceivable to improve an ESP process. In general, the indicator signal is correlated to the combustion air temperature.

There will now be described different ways in which the control arrangement 13 may influence the ESP 9 depending on the indicator signal. Even if other controlled aspects of the ESP are conceivable, three aspects are considered particularly interesting. Firstly, the ESP average current may be controlled based upon the indicator signal. Secondly, semi-pulse or transistor based pulse control schemes may be influenced, and as a third option rapping timing may be considered. Needless to say, one, two or more such aspects may be influenced by the indicator signal.

The indicator signal may be included in a control scheme in different ways. In one control scheme, the indicator signal may be included in a control algorithm, such that a continuous increase or decrease in the combustion air temperature results in a continuous change in e.g. in the ESP voltage. In another scheme, the combustion air temperature exceeding or falling short of a threshold value may trigger a specific action in the ESP or a non-continuous change in the ESP behavior. Those schemes may of course be combined. Linear, piece-wise linear, and non-linear control schemes may be considered as well as e.g. control schemes based on fuzzy logic.

In a first scheme, the ESP current is controlled based on the indicator signal. By ESP current is here meant the average current that is fed to the electrodes of the ESP in order to charge and collect particles.

Figure 2:
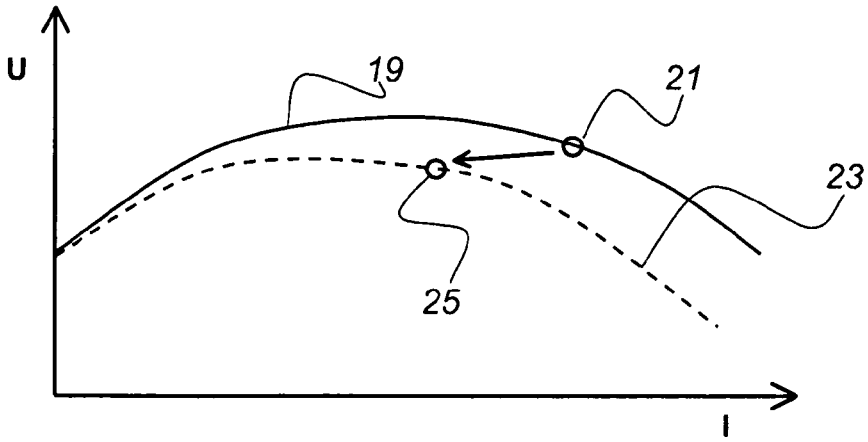
FIG. 2 illustrates the adaptation of the ESP working point to the combustion air temperature.

FIG. 2 illustrates the adaptation of an ESP working point to the combustion air temperature. The figure shows, schematically, a voltage-current characteristics 19 for an ESP indicated with the solid line. The characteristics is relevant for an ESP where some resistive dust has already been collected on an electrode. The voltage between the electrodes increases with increasing average current, but only up to a certain maximum voltage $V_{max}$. Even greater currents will result in falling voltages, mostly due to back-corona effects. Nevertheless, it may be appropriate to select a working point 21 in the range where the voltage decreases with increasing average current as the dust removal efficiency is closely correlated to the supplied power which usually has its maximum in this range.

With increasing combustion air temperature the dust composition is altered for some combustion processes as will be discussed further later. This alteration may be due to the formation of more small dust particles, having a size of a few μm, as will be discussed later. With increasing combustion air temperature, the voltage-current characteristics may therefore be altered to resemble the dashed line 23 in FIG. 2. It has been found that a greater particle resistivity may make the back-corona effects occur at a lower average current and to a greater extent.

The control arrangement of FIG. 1 may therefore alter the working point, i.e. the set average current to a lower value 25 to adapt to the new characteristics and provide a suitable ESP power. For instance, if the indicator signal is a temperature sensor signal, a control algorithm may be used that renders the ESP average current inversely dependent on the combustion air temperature within a predetermined range. The ESP current then typically rises as the combustion air becomes cooler, e.g. after sunset.

Typically, the average ESP current is changed by altering the trigger timing in a thyristors circuit, although other concepts for altering the current may be possible depending on the ESP structure.

Another parameter that may be relevant to avoid back-corona effects is the intermittent time between pulses when the ESP is supplied in a pulsed manner.

Figure 3A:
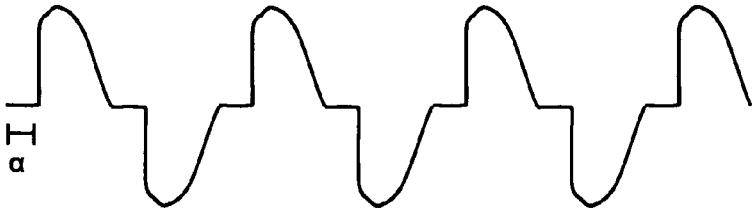
FIGS. 3A and 3B illustrate a semi-pulse control scheme using a thyristor controlled power supply.
Figure 3B:
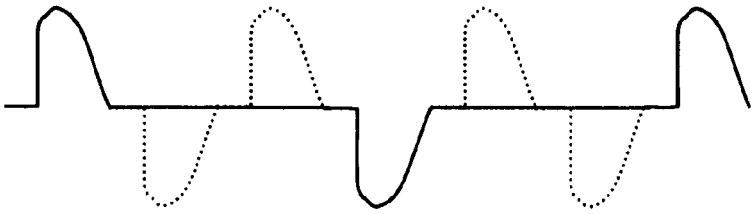

The ESP may for instance employ a so-called semi-pulse control scheme, as will be briefly described with reference to FIGS. 3A and 3B, and the operation of this scheme may be influenced by the indicator signal.

By a semi-pulse control scheme is here meant a scheme where, in an alternating current input current, not all half-periods are used to feed current to the ESP electrodes. Instead, every third, fifth, seventh, etc. (odd numbers in order to maintain an alternating current) are used. FIG. 3A illustrates for instance an alternating current as produced by a conventional thyristor controlled supply circuit. An alternating voltage, a sine wave, is applied over the circuit, and a control system decides at which instance, during each half-period, the thyristors are intended to begin conducting charges, as indicated by the control angle α in FIG. 3A. The smaller the control angle, the greater the average current. In a semi-pulse control scheme, as indicated in FIG. 3B, the thyristors are not activated at all during some half-periods. In the illustrated case, every $3^{rd}$ half-period is used, but every $5^{th}$, $7^{th}$ etc. half period could also be used.

The separating of pulses with intermittent periods reduces back-corona effects, i.e. that a potential is built up over a layer of already collected particles on an electrode which forces some of the collected dust particles back into the gas flow.

Figure 4:
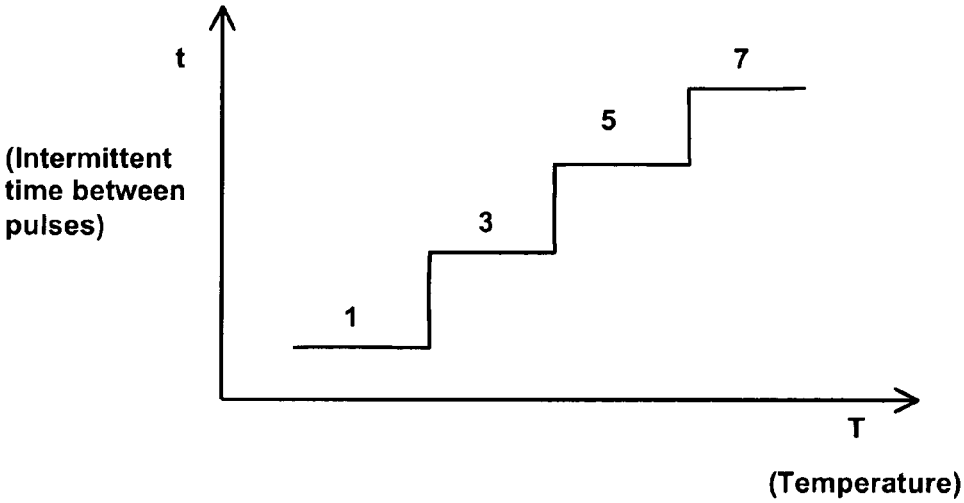
FIG. 4 illustrates how such a semi-pulse control scheme can be made dependent on the combustion air temperature.

The control arrangement (cf. 13, FIG. 1) may thus control an ESP, which uses a semi-pulse control scheme, in such a way that fewer pulses (e.g. every seventh pulse instead of every third) are used in case the combustion air temperature rises. This is schematically illustrated in FIG. 4 where a first, relatively low combustion air temperature (T) range will imply that all pulses are used "1", whereas higher temperature ranges will imply that every $3^{rd}$, $5^{th}$, etc. pulses are used such that the intermittent time (t) between pulses increases. This will reduce back-corona effects, as the average current is reduced, resulting in a lower potential across the dust layer. It is possible to maintain a desired charging level to a greater or lesser extent by simultaneously altering the aforementioned control angle α.

Figure 5:
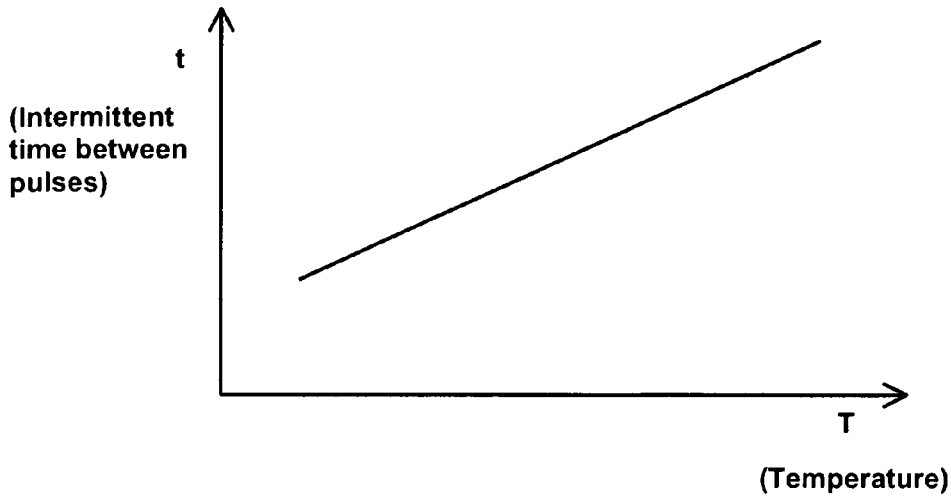
FIG. 5 illustrates how the operation of a transistor controlled power supply can be made dependent on the combustion air temperature.

A similar control scheme for a transistor controlled ESP supply circuit is illustrated in FIG. 5. In such a case the intermittent time between supply pulses may be chosen arbitrarily, without any relation to a grid frequency as is the case in a thyristor controlled system. As indicated, the intermittent time (t) may be linearly depending on the combustion air temperature (T), although this is only an example.

As mentioned, the rapping of the ESP electrodes may also be controlled based on the combustion air temperature. It is desirable to concentrate the rapping to periods when the risk of back-corona effects is comparatively small.

Figure 6:
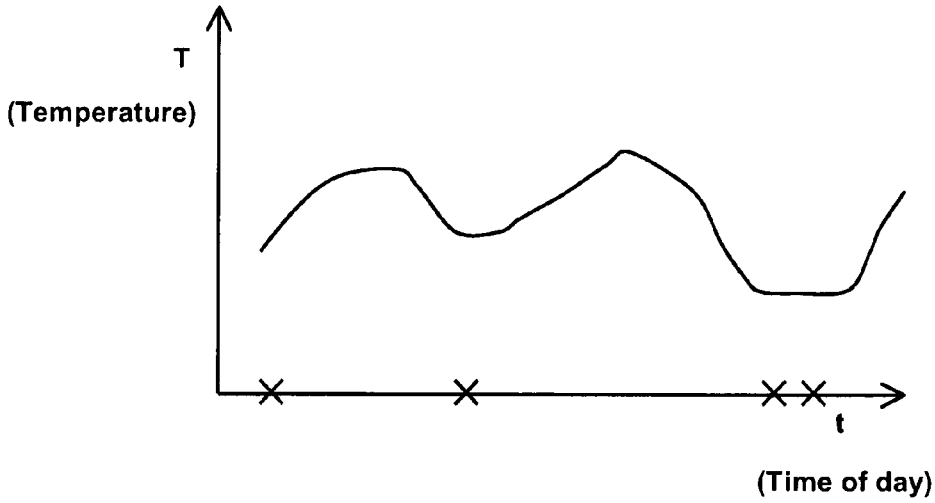
FIG. 6 illustrates how rapping timing can be optimized based on combustion air temperature.

In particular, the rapping of a last EPS section or field, or rapping with power turned off, so-called power-down rapping, may be carried out only when the combustion air temperature is at the lowest part of its cycle. FIG. 6 illustrates how rapping, indicated by the character "x" may be concentrated to points of time when the combustion air temperature is relatively low, for instance lower than a day average or a moving average.

The above disclosure is considered particularly relevant for combustion processes that are prone to generate high-resistivity dust, such as coal fired power plants. Some metallurgical processes and some cement processes. With high-resistivity dust is generally meant dust with a resistivity higher than $10^{12}$ Ωcm, even though the process may also be relevant for more conductive dust compositions. One plausible assumption as to why back-corona effects increase with increasing combustion air temperature is that the higher temperature results in the formation of more small particles, e.g. so-called PM10 particles. By PM10 particles is meant particulate matter with a diameter which is less than 10 μm, and thus the notion PM10 also includes much smaller particles.

In summary, the disclosure relates to a method or device for controlling the operation of an electrostatic precipitator, ESP. The ESP is used to remove dust particles from a process gas, which is generated by a combustion process. An indicator signal is generated, typically by means of a temperature sensor, which signal is indicative of the temperature of combustion air, which is fed to the combustion process. The ESP is operated in a manner depending on the indicator signal. Thereby back-corona effects may be avoided to a great extent.

The disclosure is not limited to the above described embodiments and may be altered in different ways within the scope of the appended claims.

The invention claimed is:

1. A method of controlling the operation of an electrostatic precipitator (ESP) operative for removing dust particles from a process gas generated by a combustion process, comprising:

generating an indicator signal indicative of a combustion air temperature for combustion air fed to the combustion process, and operating the ESP in a manner depending on the indicator signal.

2. A method according to claim 1, wherein an average current fed to electrodes of the ESP is controlled depending on the indicator signal, with the average current decreasing with increasing combustion air temperature.

3. A method according to claim 2, wherein the electrodes of the ESP are fed with pulses, and intermittent time between the pulses is increased with increasing combustion air temperature.

4. A method according to claim 3, wherein the intermittent time is increased by utilizing fewer potential pulses in a semi-pulse arrangement.

5. A method according to claim 4, wherein rapping of ESP electrodes occurs when the combustion air temperature is comparatively low.

6. A method according to claim 1, wherein the indicator signal is generated by means of a temperature sensor.

7. A method according to claim 1, wherein the indicator signal is generated by means of a timer.

8. A device for controlling the operation of an electrostatic precipitator (ESP) operative for removing dust particles from a process gas generated by a combustion process, comprising: an indicator signal indicative of a combustion air temperature of combustion air fed to the combustion process, and an electrostatic precipitator operative in a manner depending on the indicator signal.

9. A device according to claim 8, wherein the device is configured to control an average current fed to electrodes of the ESP based on the indicator signal, with the average current decreasing with increasing combustion air temperature.

10. A device according to claim 9, wherein the electrodes of the ESP are fed with current pulses, and the device is configured to control intermittent time between pulses, with the intermittent time increasing with increasing combustion air temperature.

11. A device according to claim 10, wherein the intermittent time is increased by utilizing fewer potential pulses in a semi-pulse arrangement.

12. A device according to claim 11, wherein the device is configured to initiate rapping of ESP electrodes when the combustion air temperature is comparatively low.

13. A device according to claim 8, wherein the indicator signal is generated by means of a temperature sensor.

14. A device according to claim 8, wherein the indicator signal is generated by means of a timer.

* * * * *